United States Patent [19]

Hallez

[11] Patent Number: 4,856,719

[45] Date of Patent: Aug. 15, 1989

[54] CUTTING ARM

[75] Inventor: Charles P. Hallez, Tellin, Belgium

[73] Assignee: Diamant Boart, Bruxelles, Belgium

[21] Appl. No.: 172,092

[22] Filed: Mar. 23, 1988

[30] Foreign Application Priority Data

Mar. 23, 1987 [BE] Belgium ..... 8700290

[51] Int. Cl.[4] ..... B02C 19/00

[52] U.S. Cl. ..... 241/200; 299/63

[58] Field of Search ..... 241/200; 299/63, 82, 299/83, 84

[56] References Cited

U.S. PATENT DOCUMENTS 2,344,750 3/1944 Stoltz ..... 299/82
2,354,781 8/1944 Stoltz ..... 299/82
2,664,120 12/1953 Hinkley ..... 299/82
4,492,030 1/1985 Beerens ..... 299/82 X

*Primary Examiner*—Timothy V. Eley
*Attorney, Agent, or Firm*—Sughrue, Mion, Zinn, Macpeak & Seas

[57] ABSTRACT

In accordance with the invention, on the periphery of the motor wheel (8) and the return wheel (9) of a cutting arm, grooves (18) are provided which are separated from one another by ridges (19). This arrangement enables the traction couple to be transmitted to the endless component (10), which is provided on the exterior with cutting tools (11) and on the interior with guide plates (12), by the assembly of fibers adjacent to the principal fibers of the endless component (10) and not by the guide plates (12).

7 Claims, 3 Drawing Sheets

CUTTING ARM

BACKGROUND OF THE INVENTION

The present invention relates to a cutting arm on which is stretched on endless component which is driven in rotation by a motor wheel and a return wheel. The arm is provided externally with cutting tools intended to carry out the cutting and demolition of rocks and internally with guide plates which are capable of following a groove provided along said arm.

A cutting arm provided on a rock cutting machine is already known from European Patent No. 0 014 776, which comprises a frame bordered by sliders on the ends of which a driving wheel and a return wheel of an endless component are respectively mounted. This endless component generally consists of a belt externally bearing cutting tools and internally guide plates composed of blocks extending into a groove. In service, the blocks slide over the entire width of the groove on a sheet of fluid provided by means of injectors provided at the bottom of the groove. In the known machines, the sliders are fixed onto the belt by means of screws traversing the belts. The major disadvantage of such fixing is a local weakening of the belt at the points of fixing, since the fixing holes constitute discontinuities which are capable of causing concentrations of tension and bending stresses.

The motor wheel and the return wheel comprises a solid core with a uniform thickness and with a circumferential periphery provided with a rough coating.

In operation, the sliders take support without sliding against the rough coating of the motor wheel in order to drive the belt. To prevent the sliding of the sliders on the motor wheel due to lack of adhesion, it is necessary to stretch the belt as much as possible between the motor wheel and the return wheel. Such a traction pre-stress obviously causes premature wear of the belt.

A cutting arm of a coal cutting machine is also known from German Patent Application DE-A No. 3128264, which comprises an endless belt with a trapezoidal cross-section which is provided externally with diamond cutting components and internally with guide plates. The belt is driven in rotation by a motor wheel and by a return wheel provided with a trapezoidal groove whose inclined walls enclose the sides of the belt.

The belt is provided on its exterior surface with cogs on which are fixedly encased tool-bearing components which are fixed by means of pins engaged in transversal holes.

This configuration allows the full absorption, by means of support surfaces provided for this purpose between the tool head and the tool body, of the considerable shocks to which the tool heads are subjected It also enables damage of the fixing pins to be prevented in a sure manner.

The major disadvantage of this known cutting arm resides in the fact that the belt is subjected to considerable and repeated flexions at the ends of each of the plates during each passage on the motor and return wheels. These repeated flexions cause localized fatigue of the belt and cause the progressive breakage of same.

SUMMARY OF THE INVENTION

The present invention seeks to overcome the above-mentioned disadvantages. It relates to a cutting machine comprising a cutting arm on which is stretched an endless component which is driven in rotation by a motor wheel and a return wheel, which is provided externally with cutting tools intended to carry out the cutting and demolition of rocks and which is provided internally with guide plates capable of following a groove provided along said arm.

With a view to providing a cutting machine equipped with a cutting arm with an endless component, which has increased longevity, it proposes providing on the periphery of the motor wheel and the return wheel grooves which are separated from one another by ridges and which are intended to receive said guide plates without any contact of the guide plates against the wheels.

In a preferred embodiment, the endless components is a notched belt.

The ridges separating said grooves on the motor and return wheels are provided with small teeth which engage in corresponding indentations of the notched belt.

In accordance with one characteristic of the invention, the upper surface of the plate support has hollows which are intended to receive the indentations of a notched belt.

In a particular embodiment, the lower part of the metal tool body has a possibly movable sole plate (22) in a synthetic material.

Other characteristics and details of the invention will become apparent from the following detailed description which refers to the attached drawings which represent schematically and in a non-limiting manner one embodiment of the device in accordance with the invention.

BRIEF DESCRIPTION OF THE DRAWING

In these drawings, the same reference numerals designate identical or similar components.

DETAILED DESCRIPTION OF PREFERRED EMBODIMENTS OF THE INVENTION

Figure 1:
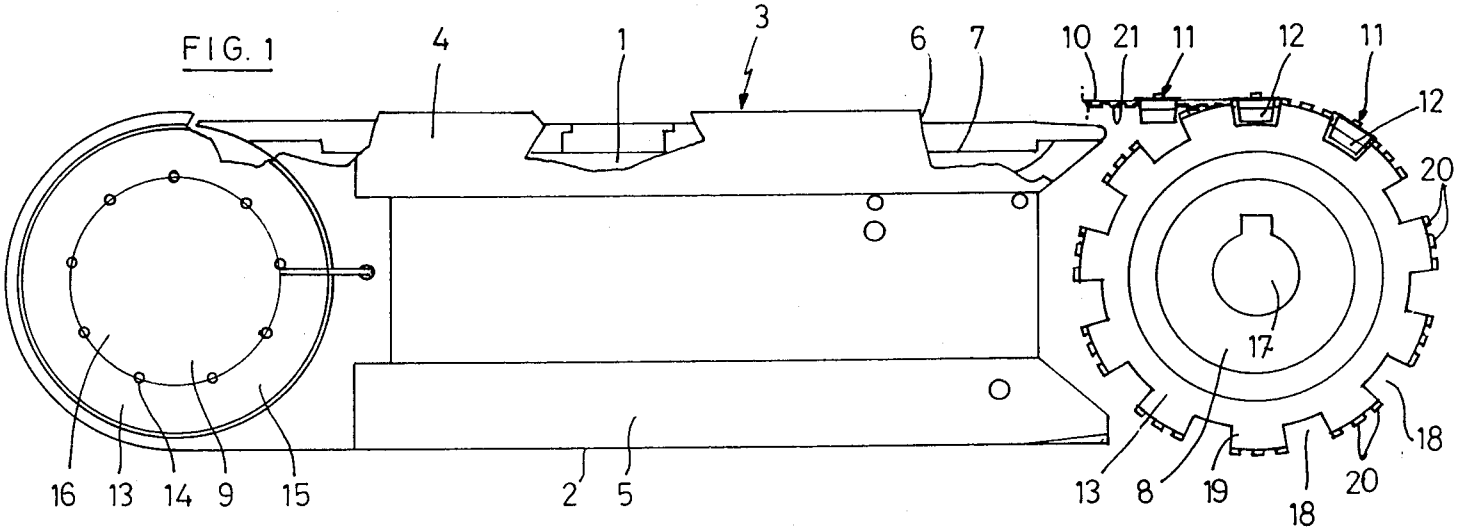
FIG. 1 is a partially torn elevated view of a cutting arm in accordance with the invention.

As illustrated in FIG. 1, a cutting arm comprises a one-piece frame with a soldered construction.

The frame is essentially composed of an upper slider 1 and a lower slider 2 formed of small beams forming a framework 3 which is covered on both sides by lateral sheets 4 and 5 overlapping sliders 1, 2 so as to form an upper groove 6 whose width is equal to that of the sliders 1, 2.

As described in European Pat. No. 0 014 776, groove 6 is supplied with water through injectors 7 provided at the bottom of said groove.

One end of the cutting arm carries a motor wheel 8 and the other end a return wheel 9. An endless component is stretched on said wheels, which component is composed, for example, of a notched belt 10. This belt 10 is fitted externally with components bearing cutting tools 11 which are intended to carry out the cutting and demolition of rocks and internally with guide plates 12 which are capable of following the groove 6 provided along sliders 1, 2 of the cutting arm.

The motor wheel 8 and the return wheel 9 each contain a solid core 13 which has a uniform thickness and is mounted by screws 14 onto a plate 15. The core is enclosed between two supports 16. The plate 15 is mechanically connected to an output shaft 17 of an electric motor (not shown), which is mounted on the framework of the cutting arm.

The core 13 of the motor wheel 8 and of the return wheel 9 have grooves 18 which are separated from one another by ridges 19 which are provided with teeth 20 which engage in the indentations 21 of the notched belt 10.

When the notched belt 10 moves under the action of the motor wheel 8, the guide parts slide in the grooves of the sliders and enter into the grooves 18, so as to enable the notched belt to take support on the ridges provided with teeth 20.

The teeth engage in the indentations 21 of the notched belt and force said belt to adhere to the motor wheel by preventing any sliding.

This arrangement has the advantage of transmitting the traction couple to the belt by means of the assembly of fibers adjacent to the main fibers of the notched belt and not by means of the slide plates. In this manner, the life span of the belt is increased.

Figure 2:
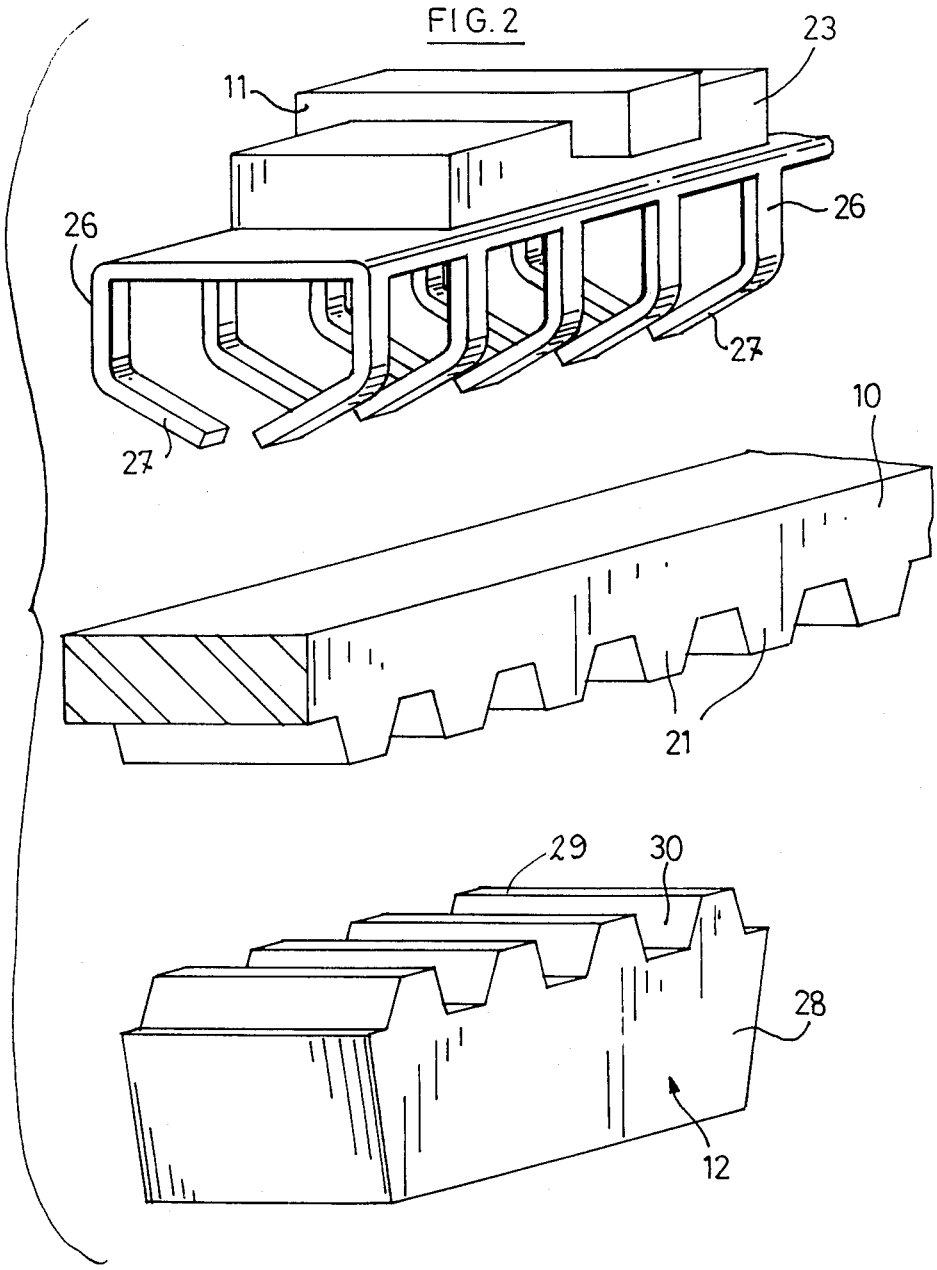
FIG. 2 shows a view of a tool-bearing component provided with a plate.
Figure 3:
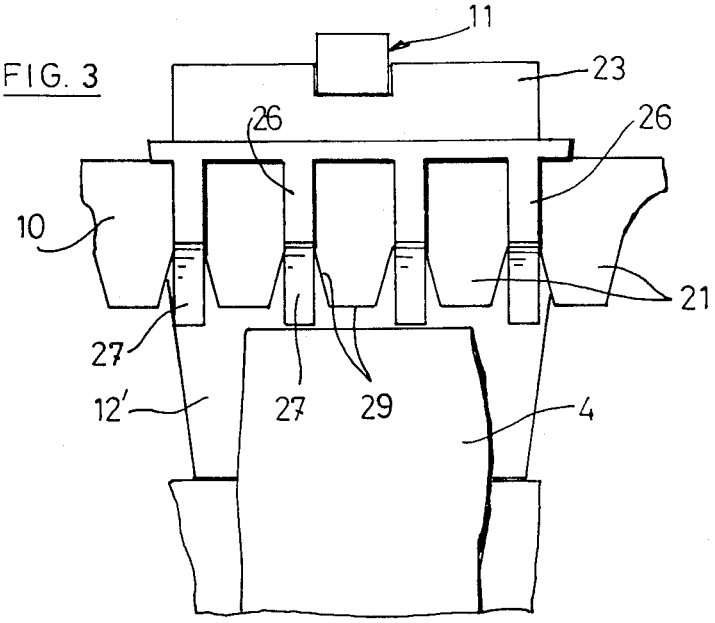
FIG. 3 is a lateral elevation of the tool-bearing component shown in FIG. 2.
Figure 4:
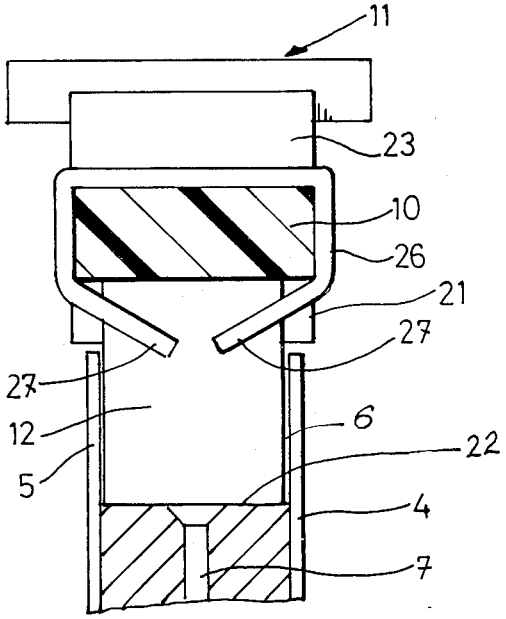
FIG. 4 is an end view of the tool-bearing component shown in FIGS. 2 and 3.

FIGS. 2 to 4 show different angles of a tool-bearing component, designated overall by the reference numeral 23, for a cutting arm and cutting device using an endless component 10. Each cutting tool 11 comprises a cutting component (not shown) hard-soldered to the tool-bearing component 23 with an inverted U-shaped cross-section. The inverted U-shaped branches 26 have on their interior, and preferably at their ends, lugs 27 or claws intended to grip the indentations 21 of the notched belt 10. These claws 27 of the tool body 23 are bent back in the lateral sides 28 of a guide plate 12' arranged against the interior surface of the endless component 10.

When the endless component is a notched belt, the upper surface 29 of the plate 12' has grooves 30 which are intended to receive indentations 21 of the notched belt 10.

Plates 12' are fixed to the tool body 23 without altering or weakening the belt. They can possibly be movably fixed.

It is obvious that the invention is not exclusively limited to the embodiment shown and that many modifications can be made to the shape, the arrangement and the composition of certain components used in production provided that said modifications are not counter to the object of the following claims.

Therefore, the cutting arm in accordance with the invention can be used for the grading of sheets or blocks of hard mineral materials. The grading is a surfacing operation during which said arm, which is contained in an inclined plane of 45° in relation to the surface to be graded, is moved parallel to itself along the surface so as to entirely sweep said surface.

What is claimed is:

1. An elongated cutting arm on which is stretched an endless component (10) which is driven in rotation by a motor wheel (8) and a return wheel (9), which is fitted on its exterior with cutting tools (11) for the cutting and demolition of rocks, and which is fitted on its interior with guide plates (12) which follow a groove (6) provided along said arm, characterized in that the peripheries of the motor wheel (8) and the return wheel (9) have grooves (18) which are separated from one another by ridges (19) and which receive said guide plates (12) without any contact of the guide plates against the wheels.

2. The cutting arm in accordance with claim 1, wherein the endless component is a notched belt (10).

3. The cutting arm in accordance with claim 2, wherein the ridges (19) have teeth (20) which engage in indentations (21) of the notched belt (10).

4. The cutting arm in accordance with claim 3, wherein the cutting tools (11) are hard-soldered onto a tool body (23) which is fixed on an external surface of the notched belt (10) and which encloses the notched belt by means of claws (27) folded in lateral sides (28) of the guide plate 12' which is fixed to the interior surface of the notched belt (10).

5. The cutting arm in accordance with claim 4, wherein an upper surface (29) of the plate (12') has grooves (30) which receive the indentations (21) of the notched belt (10).

6. The cutting arm in accordance with claim 5, wherein a lower surface of each guide plate has a movable sole plate (22) of a synthetic material.

7. The cutting arm in accordance with claim 6, wherein the tool body (23) and the sole plate (22) form a single piece of molded synthetic material.

* * * * *